US006984944B2

(12) United States Patent
Garrity

(10) Patent No.: US 6,984,944 B2
(45) Date of Patent: Jan. 10, 2006

(54) CONTROLLING DEVICE FOR USE WITH EXTERIOR LANDSCAPE LIGHTING ASSEMBLIES

(76) Inventor: John Garrity, 8 N. Shore Trail East, Andover, NJ (US) 07821

( * ) Notice: Subject to any disclaimer, the term of this patent is extended or adjusted under 35 U.S.C. 154(b) by 0 days.

(21) Appl. No.: 10/756,235

(22) Filed: Jan. 13, 2004

(65) Prior Publication Data

US 2004/0195982 A1 Oct. 7, 2004

Related U.S. Application Data

(60) Provisional application No. 60/439,994, filed on Jan. 14, 2003.

(51) Int. Cl.
*G05F 1/00* (2006.01)

(52) U.S. Cl. ..... 315/294; 315/312; 315/276; 315/152; 307/112; 307/132 E; 307/140

(58) Field of Classification Search ..... 315/149, 315/152, 156, 276, 292, 294, 312, 316, 158, 315/159; 307/112–116, 132 E, 140
See application file for complete search history.

(56) References Cited

U.S. PATENT DOCUMENTS 4,563,592 A * 1/1986 Yuhasz et al. ..... 307/115
5,962,982 A * 10/1999 Mancuso ..... 315/159
6,160,353 A 12/2000 Mancuso

OTHER PUBLICATIONS

Intermatic Incorporated, Malibu ML814PR Photo Control installation instructions, 1998, 158LV9968.
Intermatic Incorporated, Instructional manual for assorted power packs and Lighting Assemblies.

* cited by examiner

*Primary Examiner*—Haissa Philogene

(57) ABSTRACT

A controlling device for use with an exterior landscape lighting assembly. The lighting assembly includes a transformer having an input line connected to an electrical power source. The transformer converts a primary electrical load to a secondary electrical load which is in turn outputted though an output line connecting to a plurality of individual lighting units. The controlling device is capable of being mounted at an appropriate location indoors or outdoors. An enclosure unit includes a power supply circuit, a switch, a relay and control circuitry. The power supply circuit converts the secondary transformer output to a filtered direct current suitable for powering the control circuitry. The control circuitry interfaces with remote momentary switches and alternately activates and deactivates the lighting units. The control circuitry further includes an optional receiver for wireless operation. The controlling device can be incorporated into the transformer assembly.

6 Claims, 6 Drawing Sheets

CONTROLLING DEVICE FOR USE WITH EXTERIOR LANDSCAPE LIGHTING ASSEMBLIES

CROSS REFERENCE TO RELATED APPLICATION

This application claims the benefit of Provisional Patent Application Ser. No. 60/439,994 filed 2003 Jan. 14.

BACKGROUND OF THE INVENTION

1. Field of Invention

The present invention relates generally to exterior landscape lighting assemblies having a specified form of switching control and, more particularly, to allow a plurality of remote positionable switches capable of being located a spaced distance from the transformer and provide practical and convenient control to a plurality of exterior lights.

2. Description on Prior Art

The prior art is well documented with outdoor landscaping assemblies and, particularly the means for activating and deactivating the outdoor lighting assemblies. Generally all landscape lighting systems are powered by 12 Volts (V) alternating current (AC) by means of a transformer which converts an AC household power input ( typically 120 V AC) to the 12 V AC suitable for this type of lighting. The transformer is a necessary component owing to the power input specifications of the various lighting elements which make up the landscaping lighting assembly.

Establishing on/off control of landscape lighting systems has traditionally been accomplished in a number of different ways, these including installing a mechanical timer on the primary winding of the transformer. The shortcoming however with simple timer assemblies is that they require frequent readjustment, particularly following power outages and with changing daylight hours.

Another type of prior art assembly includes installing a photocell device as either a part of the transformer of a separate device located remotely from the transformer. A drawback to this type of control is the photocell must be installed where it is exposed to natural light and without direct exposure to street lights, porch lights, car headlights and other lights which are directly controlled by the transformer. This can make installation more difficult. A further drawback to this type of control is the photocell will keep the lights on the entire time its dark out and more specifically will keep the lights on when it might not be practical or desirable to do so.

Neither of these assemblies provides an easily accessible switch to control the lights. In the case of the timer, if the timer has shut off the lights and you need to light a path or hear some thing outside you can't easily or quickly turn the lights on. In the case of the photocell you aren't able to easily turn the lights off.

An additional means for controlling the lighting load is by having the transformer plugged into a household power outlet (120 V AC)that is controlled by a household power switch. While this permits control of the lights with a switch, this disconnects power from the timer and makes the timer feature inoperable and unable to be used in conjunction with the household power switch. Another disadvantage is if a photocell device is used in addition with this type of control you would not be able to turn the lights on instantly by use of the household power switch because most photocell devices have a built in delay. An even further disadvantage is when more than one switch is desired it requires three conductors be connected between switches and 3-way switches be used. Further, if more than two switches are desired a 4-way switch must be installed at each additional location. And since this type of control involves 120 Volt AC household power it is required to be installed in accordance with the National Electrical Code, is considerably more costly, requires greater skill and electrical knowledge and its recommended such an installation be installed by a qualified professional.

BACKGROUND OF THE INVENTION—OBJECTS AND ADVANTAGES

Accordingly, several objects and advantages of my invention are:

(a) to provide a device which provides a more convenient, practical and flexible on/off control of landscape lighting assemblies.

(b) To provide a device which can easily be installed into new and existing installations of landscape lighting assemblies.

(c) To provide a device which can provide on/off control of landscape lights on its own or in conjunction with existing assemblies such as timers and/or a photocell device.

(d) To provide a type of on/off control of low voltage based landscape lighting assemblies which only requires 2-conductor low voltage cable and low voltage momentary switches (typical doorbell button works well) be installed at each switching location regardless of how many locations are desired.

(e) To provide and optional wireless operation using a momentary switch activating a transmitter and incorporating a receiver into the control circuitry.

(f) To permit the option of having this device be incorporated inside the transformer enclosure.

Further objects and advantages are to provide on/off control from one or more conveniently located switches which can alternately activate and deactivate the landscape lights at any time less expensively than switching household power (120 Volts AC) supplying the transformer and requiring the same simple skills as for installing landscape lighting assemblies. Still further objects and advantages will become apparent from a consideration of the ensuing description and drawings.

SUMMARY OF THE PRESENT INVENTION

The present invention is a low voltage based on/off control device for use with an exterior landscape lighting assembly, which overcomes the shortcomings of the prior art By permitting a switch or switches be installed in any convenient and practical location, indoors or outdoors, to alternately activate and deactivate a plurality of lighting units.

This invention will permit low voltage exterior lighting assemblies be used in more practical installations. For instance, just as you have switches located at opposite ends of a hallway or a staircase indoors now you can have the same convenience outdoors. It is possible to have switches located at opposite ends of a path to a garage, dock or shed for example. Another use is to have lights along a driveway or dock and if you hear some thing outside you can turn the lights on with the tap of a switch and not have to keep the lights on the entire time its dark outside.

The preferred embodiment of the controlling device includes an enclosure capable of being mounted to a wall, indoors or outdoors, and connected to the lighting system after the transformer and before the first light in the circuit. The enclosure includes a power supply, a switch, a relay and control circuitry. The control circuitry includes such components as a bounceless switch and a flip-flop circuit. Also, this Controlling Device could be easily incorporated into the existing transformer enclosure of landscape lighting assemblies.

DRAWINGS—REFERENCE NUMERALS

Figure 1:
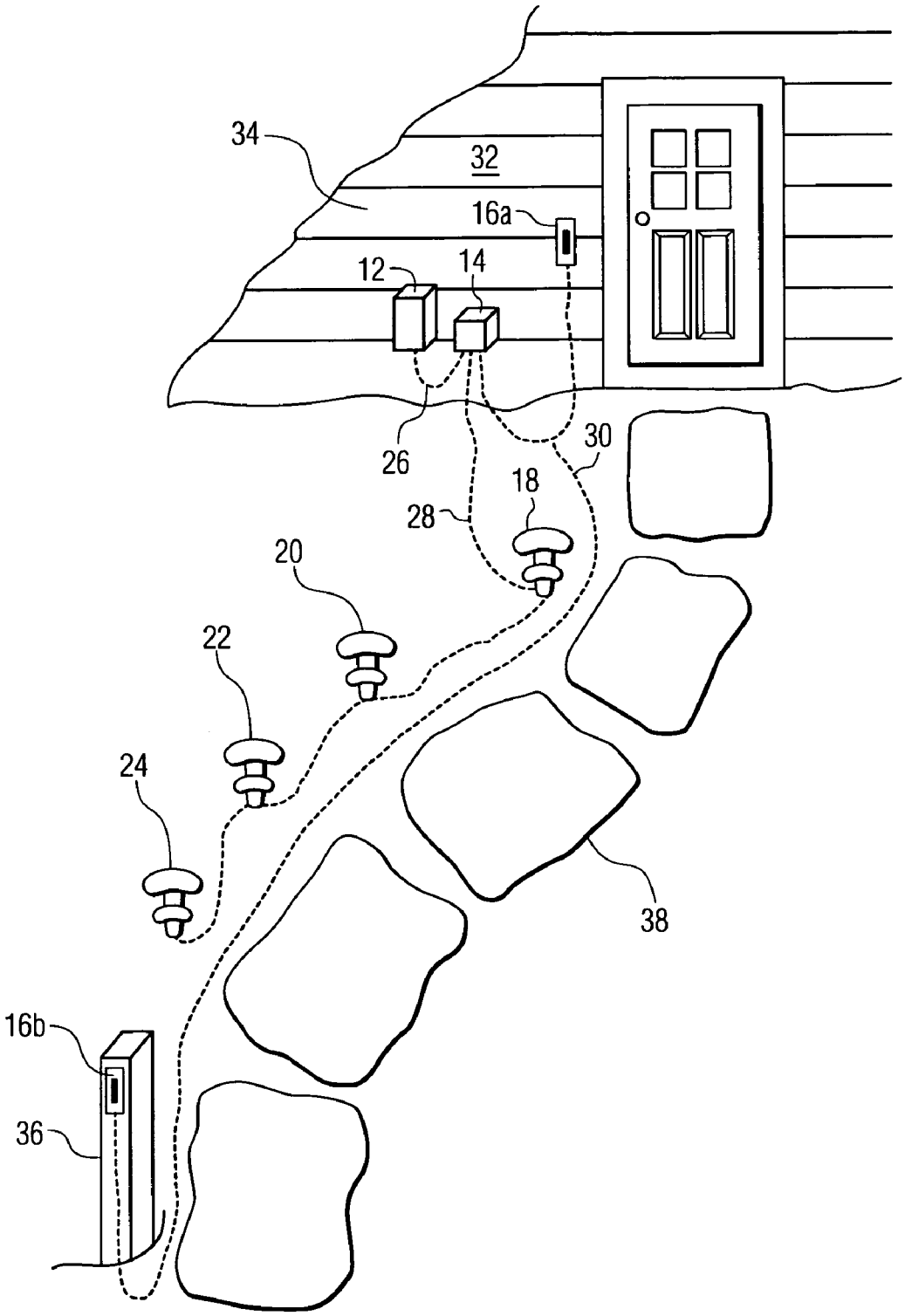
FIG. 1 is an environmental view in perspective of the controlling device and remotely located switches.

12 transformer
14 controlling device
16 momentary switch
18 typical lighting unit
20 typical lighting unit
22 typical lighting unit
24 typical lighting unit
26 output line
28 lighting load line
30 switch circuit line
32 exterior wall
34 structure
36 post
38 path
40 controlling device enclosure
42 mounting tab
44*a* input connection
44*b* load connection
44*c* switch circuit connector
46 on/off switch
48 output connection
52 power supply circuit
54 relay
56 bounceless switch circuit
58 flip/flop circuit
70 central alarm panal
80 receiver
82 transmitter

DETAILED DESCRIPTION OF THE PREFERRED EMBODIMENTS

Referring now to FIG. 1, an environmental view is shown of the controlling device 14 and remotely located switches 16*a* and 16*b* for use with an outdoor lighting assembly according to a preferred embodiment of the present invention. The remote switches, illustrated as 16*a* and 16*b*, are identical switches and are referenced with different letter suffixes to indicate their different locations. The controlling device 14 is illustrated in use with an electrical transformer 12, two remote switches 16*a* and 16*b*, and a first outdoor lighting unit 18. The transformer 12, the controlling device 14 and the switch 16*a* are all illustrated mounted on an exterior wall 32 of a structure 34. The switch 16*b* is illustrated mounted to a post 36 at the opposite end of a typical pathway 38. The lighting units 18, 20, 22 and 24 are located along the same path 38. As is known the transformer 12 functions to convert an input power source from a primary electrical load (typically 120 Volts House Power) to a stepped down 12 Volts AC suitable for most types of conventional outdoor lighting assemblies. The transformer 12 also includes an input line (not shown) connected to the electrical power source and an output line illustrated at 26. The controlling device 14 communicates with the output line 26 of the transformer 12 at any desired point between the transformer 12 and a first of the lighting units 18, 20, 22 and 24. Remote switches 16*a* and 16*b* are connected to the switch circuit line 30, which communicates with the controlling device 14. Also the transformer 12, controlling device 14 and remote switches 16*a* and 16*b* are all illustrated as installed on the exterior of structure 34 however as stated in the preceding summary of the invention any or all of these components are able to be installed inside or outside of the structure 34. A user can activate the lights from either momentary switch, 16*a* or 16*b*, walk the path and deactivate the lights from the other end of the path.

Figure 2:
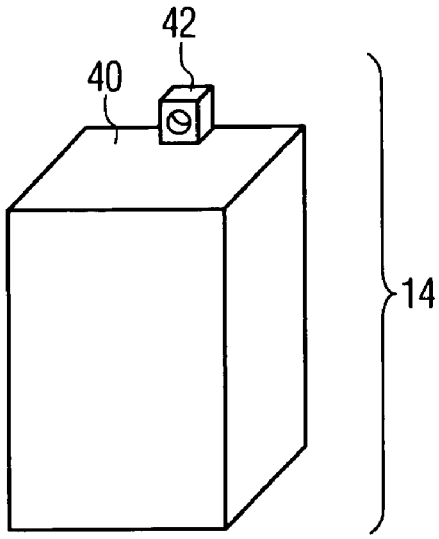
FIG. 2 is a perspective view of the controlling device enclosure.
Figure 3:
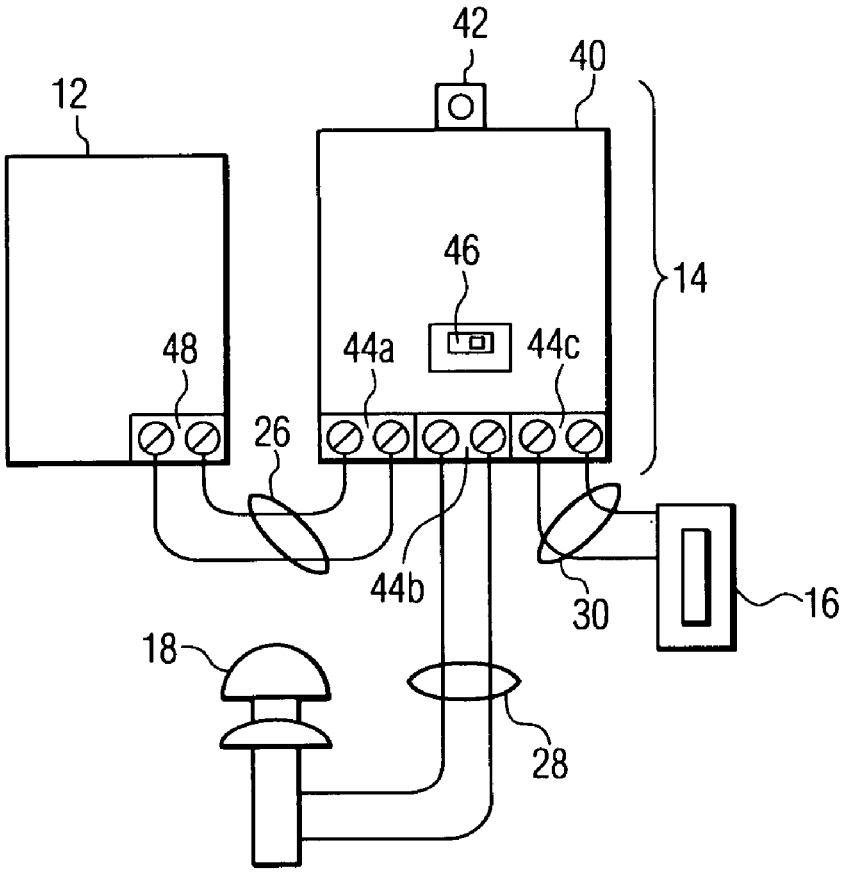
FIG. 3 is a perspective rear view of the controlling device.

Referring to FIG. 2 and FIG. 3, as illustrated the preferred embodiment of the controlling device 14 comprises of an enclosure 40 which is generally rectangular in shape and includes an interior cavity for receiving control circuitry. Located proximate the top rear of the enclosure 40 is a mounting tab 42 suitable for hanging the enclosure 40 on a nail or screw. Alternatively, other types of fasteners or securing devices including straps or bands may also be used for attaching the enclosure 40 to the surface of the structure 34.

Referring again to FIG. 3 the preferred embodiment indicates an on/off switch 46 is illustrated accessible to the exterior of the enclosure 40. Connections are made to the controlling device at connection points illustrated at the input connection 44*a*, the load connection 44*b* and the switch circuit connector 44*c* which in the preferred embodiment would be screw type terminals. The controlling device 14 receives 12 V AC power through the output line 26 which is connected to the transformer 12 at output connection 48 and connected to the controlling device 14 input connection 44*a*. The controlling device 14 activates and deactivates the lighting load through the lighting load line 28 which is illustrated connected to a first lighting unit 18 and also to the controlling device 14 at the lighting load connection 44*b*. A typical momentary switch 16 communicates with the switch circuit connector 44*c* on the controlling device 14 through the switch circuit line 30.

Figure 4:
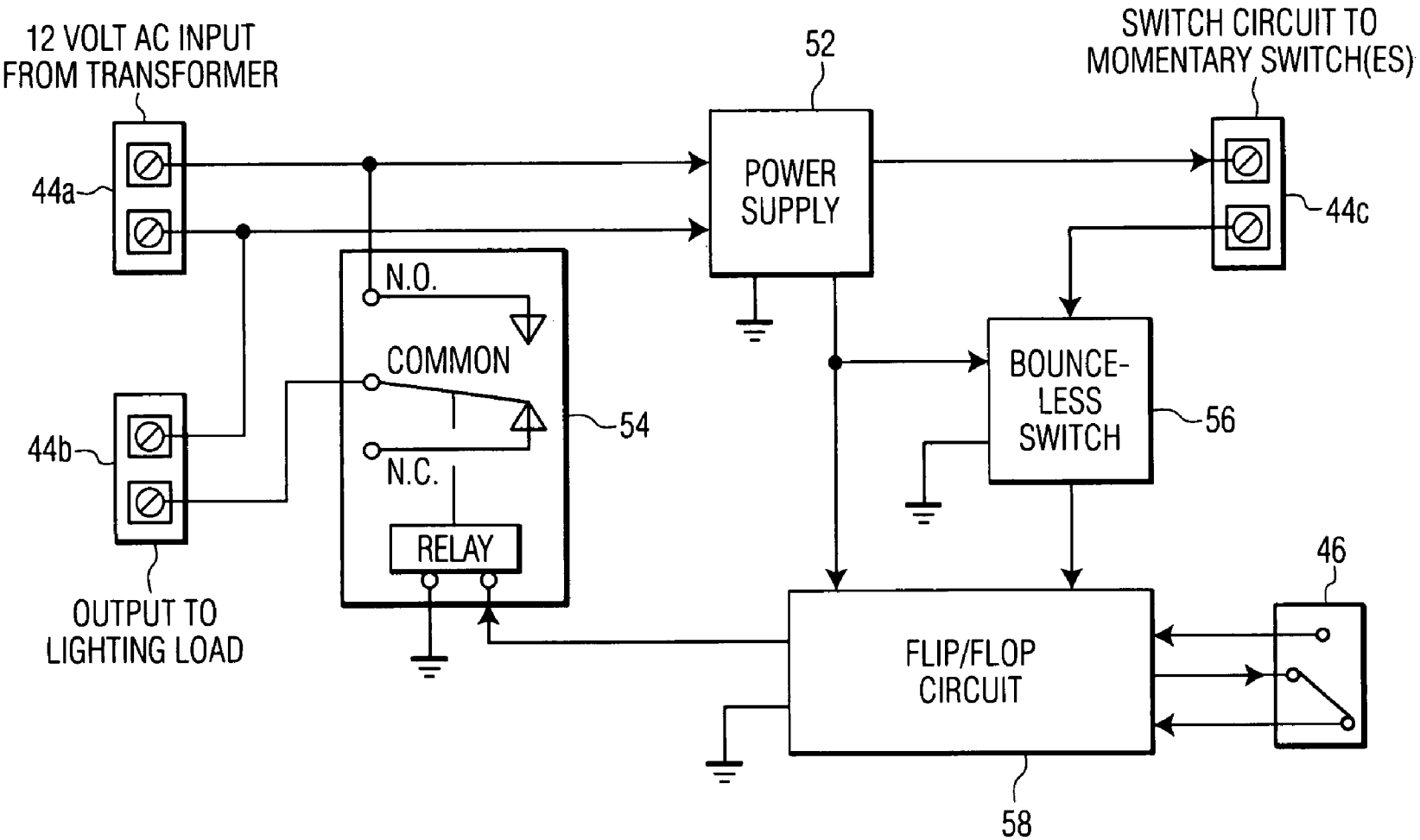
FIG. 4 is a block schematic diagram of the operation of the controlling device.

Referring again to FIG. 3 and also to FIG. 4, a block schematic of the control circuit is illustrated. 12 V AC enters the controlling device 14 at the input connection 44*a* and supplies the power supply 52. The power supply circuit 52 converts the 12 V AC into filtered and unregulated 12 V Direct Current (DC) and also into filtered and regulated 5V DC suitable for powering the integrated circuits (IC's) contained in the control circuitry. Direct Current is supplied to a first terminal of the switch circuit connector 44*c* where it will be carried through a first conductor of the switch circuit line 30 to a momentary switch 16. When the momentary switch is depressed it sends a momentary signal back through a second conductor of the switch circuit line 30 to a second terminal of the switch circuit connector 44*c*. From the second terminal of the switch circuit connector 44*c* the momentary signal enters the bounceless switch 56 part of the control circuitry. The momentary signal contains chatter from the momentary switch 16 which is unsuitable for the IC's (integrated circuits) contained in the flip-flop circuit 58. The bounceless switch 56 filters the chattered momentary signal into a single pulse that is suitable for the electronic components. When the flip-flop circuit receives a single pulse it alternately activates and deactivates the relay 54. A single pole double throw switch 46 is also connected to the flip-flop circuit 58. The position of the switch 46 determines whether the relay 54 is initially activated or deactivated when 12 V AC is initially supplied to the input connection 44*a* of the controlling device 14.

12 V AC is supplied from a first terminal of the input connector 44*a* to a normally open contact of the relay 54. The common contact of the relay 54 is connected to a first terminal of the lighting load connector 44*b*. A second terminal of the lighting load connector 44*b* is connected to a second terminal of the input connector 44*a*. When the relay 54 is activated it closes the normally open and common contacts inside the relay 54 completing a 12 V AC circuit from the transformer 12 to the lighting unit 18 and thus turning the lighting units on.

Referring back again to FIG. 3 and FIG. 4, the on/off switch illustrated as 46 permits even more flexibility to the operation of the controlling device 14. If the controlling device 14 is to be used as the only means of controlling an outdoor lighting system you can manually turn the lights on and off at any time from any of the momentary switches 16. In this case the transformer 12 will always be supplying 12 V AC power to the input connection 44*a* of the controlling device 14 so the position of the on/off switch 46 will only determine the state of the lights after a power failure is restored. If the controlling device 14 is to control the outdoor lighting system in conjunction with a timer and or photocell, and the on/off switch 46 is in the on position it will permit automatic control of the lights from either the timer and/or photocell while still permitting manual control at any time the timer and or photocell are supplying power to the controlling device 14.

Figure 5:
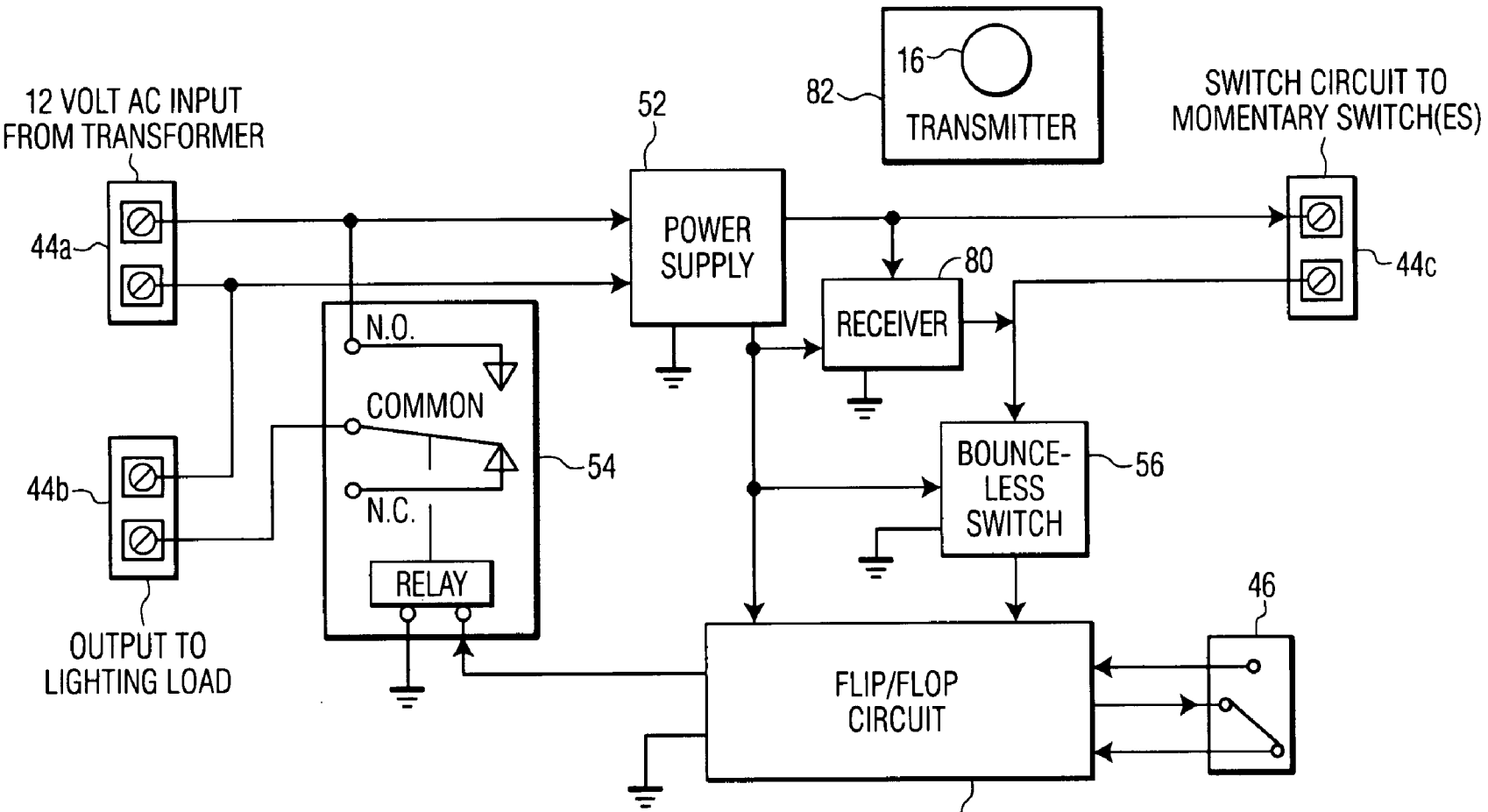
FIG. 5 is a block schematic diagram of an optional remote control for the controlling device.

Referring to FIG. 5, a block schematic diagram illustrates a variation of the controlling device which incorporates a remote control option. A receiver component 80 is connected in parallel to the switch circuit. The transmitter, illustrated as 82, has a momentary switch 16 which when depressed sends a momentary pulse to the receiver 80 which in turn sends a momentary pulse into the bounceless switch 56 permitting wireless operation. This option will permit the transmitter 82 activate or deactivate the lights from a remote location such as turning on driveway lights from an automobile.

Figure 6:
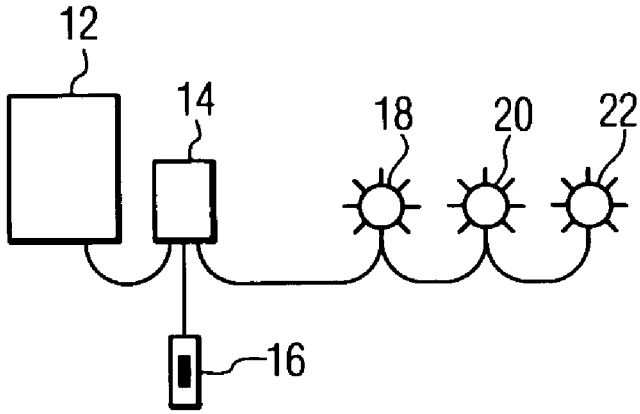
FIG. 6 is a wiring diagram of the present invention in a typical installation of the present invention.

Referring to FIG. 6, a wiring diagram illustrated a typical installation including a transformer 12, controlling device 14, a momentary switch 16 (a typical doorbell button is suitable) and lighting units 18, 20 and 22.

Figure 7:
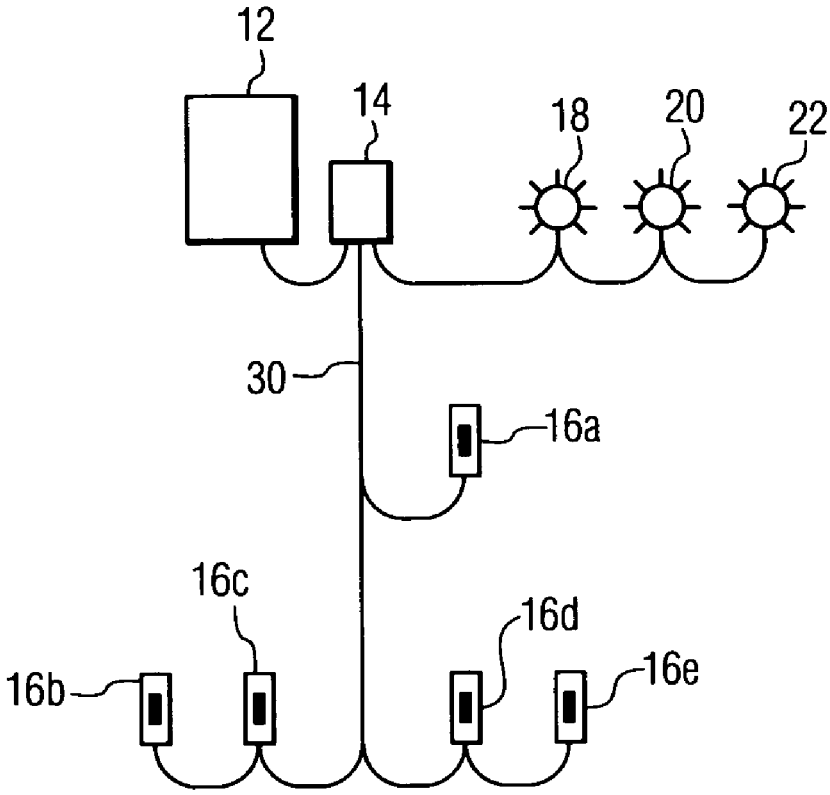
FIG. 7 is a wiring diagram illustrating a further variation to a typical installation.

FIG. 7, a wiring diagram, illustrates that additional switches 16*a, b, c, d* and *e* are simply connected in parallel at any point to the switching control line 30. This will permit switches be located in as many different and convenient locations as desired. Depressing any switch will alternately activate and deactivate the lights.

Figure 8:
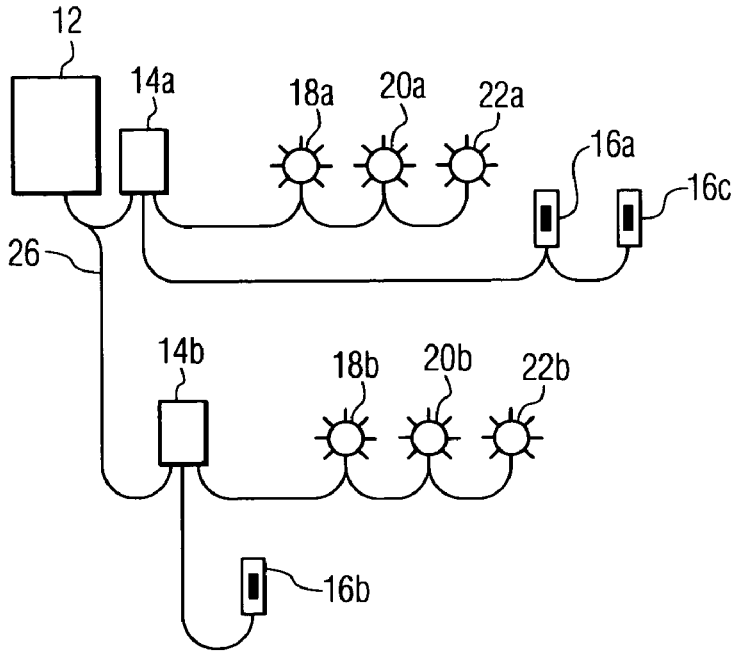
FIG. 8 is a wiring diagram illustrating an even further installation variation of the present device.

FIG. 8, a wiring diagram, illustrates a second controlling device 14*b* connected in parallel with controlling device 14*a* to the output line 26 of a single transformer 12 demonstrating that two (or more) controlling devices can be used to separately control separate lighting loads indicated as 18*a*, 20*a* and 22*a* for one lighting load and 18*b*,20*b* and 22*b* for the second lighting load.

Figure 9:
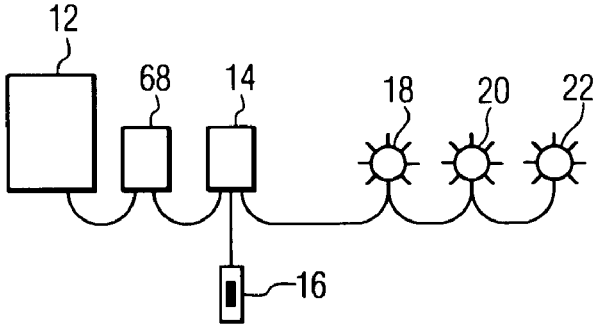
FIG. 9 is a wiring diagram illustrating the use of a remote photocell device in conjunction with the present invention.

FIG. 9, a wiring diagram, illustrates a typical installation of the controlling device 14 wired in conjunction with a remote photocell device 68. The remote photocell device 68 only permits 12 V AC to the controlling device 14 when its dark outside. If the switch 46, which is illustrated in FIG. 3, is in the on position the photocell will activate the lights at dusk and deactivate the lights at dawn while permitting manual control of the lights at anytime by use of the controlling device 14. If the switch 46, again illustrated in FIG. 3, is in the off position the photocell device will prevent the lights from being activated during daylight hours and still permit manual control of the lights using the controlling device 14 at anytime it is dark outside.

Figure 10:
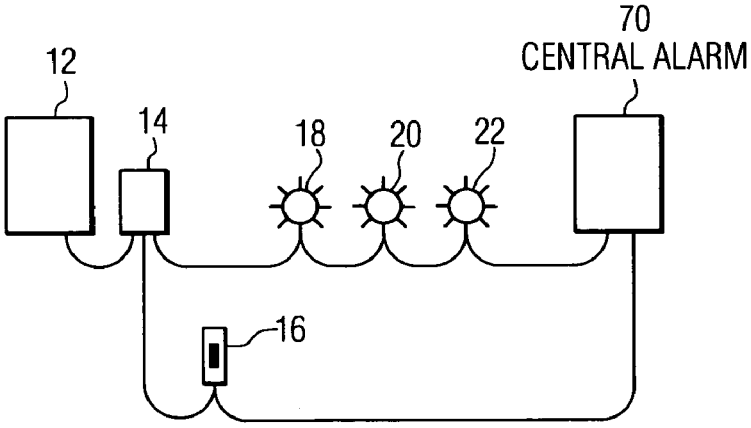
FIG. 10 is a wiring diagram illustrating that the present invention permits control from central burglar and/or fire alarm panels.

FIG. 10, a wiring diagram, illustrates a further use of the present invention in that it can be easily wired to an auxiliary contact of a central burglar and/or fire alarm system 70 to unsure that the lights are activated when trouble is detected. Even further the auxiliary contact connection can be easily modified to pulse when trouble is detected in turn causing the lights to flash on and off. This would assist emergency personnel in locating the home during nighttime hours.

In addition to the capabilities previously described, the controlling device of the present invention can be used on indoor low voltage lighting assemblies using 12 V AC power and provide the same convenience and practicalities provided to outdoor lighting assemblies.

It is therefore evident that the controlling device of the present invention provides improvements over prior art assemblies in providing greater flexibility and more practical installations of landscape lighting assemblies.

Having described my invention, additional embodiments will become apparent to those skilled in the art to which it pertains without deviating from the scope of the appended claims.

I claim:

1. A controlling device for use with exterior landscape lighting assembly, the lighting assembly including a transformer having an input line connected to a power supply and an output line connecting to a plurality of individual lighting units, said controlling device comprising:

an enclosure unit including a power supply circuit, a relay and control circuitry operatively communicating with said relay and a means for communicating electrically with a plurality of momentary switches;

said controlling device electrically communicating with the output line of the transformer and prior to a first of the plurality of individual lighting units, said power supply circuit converting a secondary electrical load through the output line to a filtered direct current suitable for powering said control circuitry, said control circuitry selectively activating and deactivating the secondary electrical load to said plurality of individual lighting units; and means for supporting said enclosure indoors or outdoors.

2. The controlling device according to claim 1, further comprising the transformer output being provided at 12 V AC.

3. The controlling device according to claim 1, said control circuitry further comprising a bounceless switch circuit to filter chatter in the electrical signal received from a plurality of momentary switches.

4. The controlling device according to claim 3, further comprising a flip-flop integrated circuit to alternately activate and deactivate said relay, an on/off switch to communicate the initial state of said flip-flop integrated circuit when said controlling device initially receives power.

5. The controlling device according to claim 3, further comprising a receiver circuit to receive a wireless signal to activate and deactivate said relay.

6. The controlling device according to claim 1, wherein the controlling device is incorporated into said transformer.

* * * * *